United States Patent [19]

Brandt

[11] 3,969,622

[45] July 13, 1976

[54] SOCKET LOCKING STRUCTURE

[76] Inventor: Neil W. Brandt, 55 Laron Drive, New Rochelle, N.Y. 10804

[22] Filed: June 19, 1975

[21] Appl. No.: 588,216

[52] U.S. Cl. ..... 240/140; 240/153

[51] Int. Cl.[2] ..... F21V 7/00; F21V 17/06

[58] Field of Search ..... 240/132, 135, 136, 137, 240/140, 143, 148, 153

[56] References Cited

UNITED STATES PATENTS

| | | | |
|---|---|---|---|
| 815,545 | 3/1906 | Marten et al. | 240/140 |
| 836,490 | 11/1906 | D'Olier, Jr. | 240/137 X |
| 964,646 | 7/1910 | Hubbell | 240/140 |
| 2,118,833 | 5/1938 | Arras | 240/143 |

FOREIGN PATENTS OR APPLICATIONS

| | | | |
|---|---|---|---|
| 557,210 | 4/1923 | France | 240/140 |
| 582,647 | 10/1924 | France | 240/132 |
| 222,739 | 7/1909 | Germany | 140/ |

*Primary Examiner*—Joseph F. Peters, Jr.
*Attorney, Agent, or Firm*—Charles E. Temko

[57] ABSTRACT

An improved electrical socket lock device for preventing accidental disassembly of a conventional electrical socket employed for supporting a lamp bulb and associated reflector. The device comprising a planar member surrounding the base of said socket and an elongated wire member, both free ends of which are engaged under tension with said planar member. The wire member is of looped configuration, and extends through openings in the reflector which is threadedly associated with a sleeve portion of said socket to maintain said socket and reflector rigidly together.

1 Claim, 7 Drawing Figures

FIG. 2
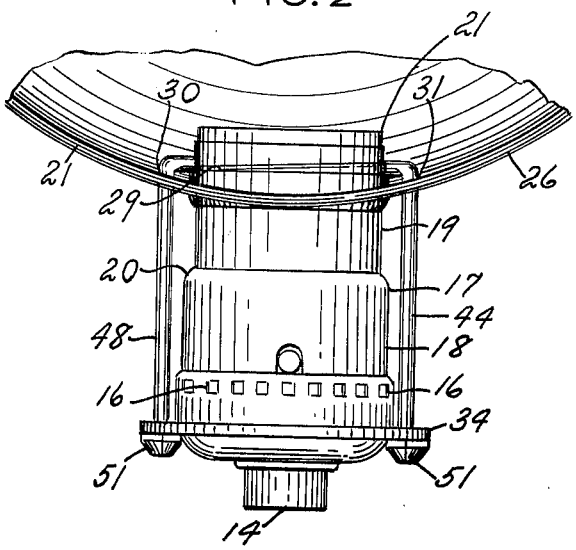
FIG. 3
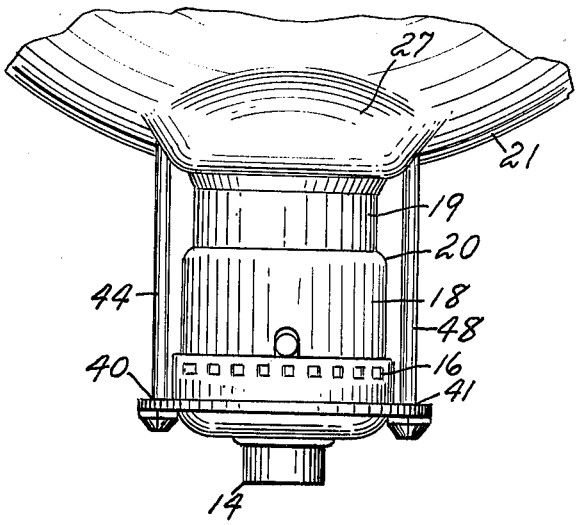
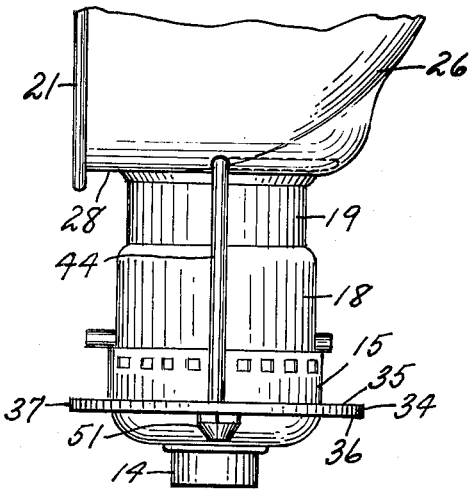
FIG. 4
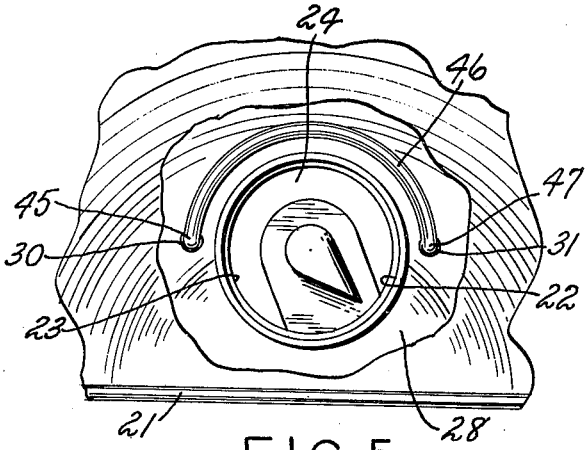
FIG. 5
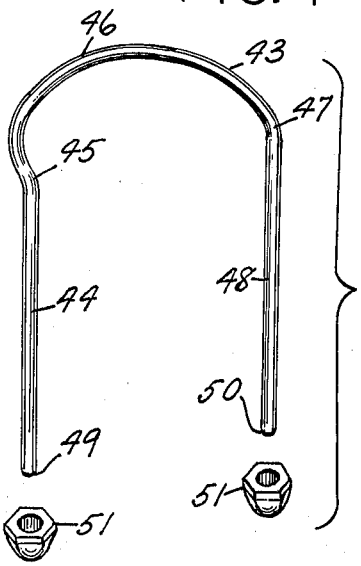
FIG. 7
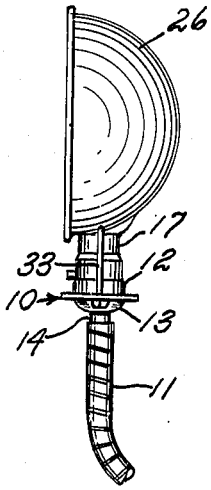
FIG. 1
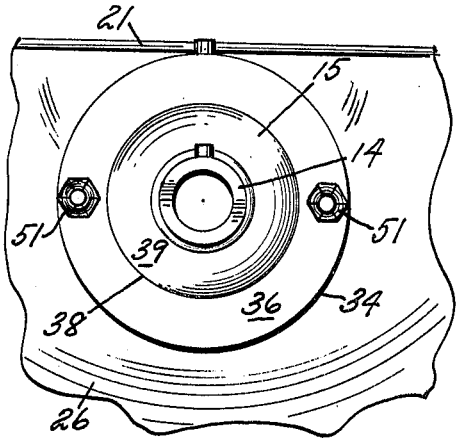
FIG. 6

SOCKET LOCKING STRUCTURE

BACKGROUND OF THE INVENTION

This invention relates generally to the field of electrical lighting fixtures, and more particularly to means for preventing accidental disassembly of lamp sockets employed in socalled "goose neck" constructions in which a lamp and reflector are supported for adjustment upon a length of flexible sheathed metallic conduit. Conventional lamp sockets are held together by a series of resilient detents interconnecting a base portion with a sleeve portion, and with repetitive adjustment of the structure, normally manually imparted to the reflector which is threadedly engaged upon the sleeve portion, the detents tend to loosen, ultimately causing separation of the sleeve portion from the base and accompanying annoyance to the user.

It is known in the art to provide a pair of rings interconnected by a plurality of threaded bolts to hold the two parts of the socket together, one ring surrounding the base and the other surrounding a portion of the sleeve of reduced diameter. Such constructions are relatively expensive, and make no provision for preventing movement of the shade relative to the sleeve.

SUMMARY OF THE INVENTION

Briefly stated, the invention contemplates the provision of an improved clamping structure including a ring-like socket engaging member and a looped wire-like component secured to the socket base engaging member at each end thereof and penetrating a pair of openings in a lamp shade supported upon the socket, whereby both socket and shade are placed under tension to prevent relative disengagement. The looped wire-like component is bent to clear an incandescent lamp carried by the socket, whereby lamp replacement is possible without the necessity of disassembling the clamping structure.

BRIEF DESCRIPTION OF THE DRAWING

In the drawing, to which reference will be made in the specification, similar reference characters have been employed to designate corresponding parts throughout the several views.

FIG. 1 is a fragmentary view in elevation of an embodiment of the invention.

FIG. 2 is an enlarged fragmentary view in elevation corresponding to the left hand central portion of FIG. 1. FIG. 3 is an enlarged fragmentary view showing the side opposite that seen in FIG. 2.

FIG. 4 is an enlarged fragmentary view as seen from the right hand portion of FIG. 2.

FIG. 5 is an enlarged fragmentary view as seen from the upper portion of FIG. 2, partly broken away to show detail.

FIG. 6 is a fragmentary bottom plan view as seen from the lower portion of FIG. 1.

FIG. 7 is an exploded view in perspective of the locking means comprising a part of the embodiment.

DETAILED DESCRIPTION OF THE DISCLOSED EMBODIMENT

In accordance with the invention, the device, generally indicated by reference character 10 is illustrated in FIG. 1 in installed condition upon a conventional lamp structure having a goose neck conduit 11, and a conventional socket element 12. The socket element 12 includes a base member 13 having threaded engagement means 14 and a cup-like portion 15 having a series of openings 16 forming detent means. A stepped tube-like sleeve member 17 includes a larger diameter portion 18 having projections (not shown) engaging the opening 16 and a portion of smaller diameter 19 interconnected by a tapered portion 20. The upper end 21 of the number 17 is threaded to support a similarly threaded reflector, and defines an opening 22 for the entry of a lamp to be engaged by a threaded metal socket 23 the base 24 of which includes an electrical contact of know design.

The shade element 26 is generally hemispherically shaped and includes a mounting enlargement 27 forming a planar surface 28 having a threaded opening 29 therein engaging the sleeve member 17 in well known manner. Adjacent the opening 29 are a pair of smaller openings 30–31, the purpose of which will more fully appear.

To maintain the shade element in threaded relationship upon the sleeve member 17, and prevent accidental dislocation of the sleeve element with respect to the base member 13, a clamping structure 33 is provided. It includes a planar annular ring 34 most conveniently formed as a stamping operation and bordered by first and second surfaces 35–36, an outer peripheral edge 37 and an inner peripheral edge 38 adapted to bear against the outer surface 39 of the cup-like member 15. On either side of the opening formed by the edge 38 are a pair of spaced openings 40–41 through which both ends of a wire-like looped retaining member 43 pass.

The member 43 includes a first rectilinear portion 44 connected to a first bend portion 45, a second larger radius bend portion 46, a third small radius bend portion 47 and a second symmetrically disposed rectilinear portion 48. The ends 49 and 50 of the members 43 and 48 are maintained within the openings 40–41 by sheet metal fasteners 51. If desired, conventional threaded nuts (not shown) may be used as an alternate fastening means.

During assembly, the retaining member 43 is first passed through the openings 30–31, either before or after engagement of the reflector element 26 upon the sleeve member 17. The free ends of the member 43 are then engaged within the openings 40–41 of the ring member 34, following which the fasteners 51 are applied to place the reflector, sleeve member and cup-like member comprising the socket all under tension. It is to be noted that the larger radius bend portion 46 passes around the upper end of the sleeve member 17 so as not to interfere with subsequent engagement of a lamp (not shown) or its removal as required.

As will be observed, the entire device comprises only a single sheet metal stamping and a length of bent wire held in position by sheet metal fasteners, whereby the entire cost of fabrication may be maintained at a minimum. Thus, the structure can be incorporated into a variety of lighting fixtures of this general type without substantially increasing the total cost of manufacture.

I wish it to be understood that I do not consider the invention limited to the precise details of structure shown and set forth in this specification, for obvious modifications will occur to those skilled in the art to which the invention pertains.

I claim:

1. In a combination lamp socket and reflector assembly of a type in which a socket element includes a cup-like base and a cylindrical sleeve maintained in assembled relation with said base by resilient detent means, said reflector being carried by said sleeve, improved means for maintaining said assembly in integrated condition comprising: a planar ring-like base member having a generally centrally disposed opening of diameter less than that of said cup-like base of said socket element, said base member having a pair of openings therein bordering said centrally disposed opening; and a looped wirelike member having free ends thereof penetrating and secured within said pair of openings in said base member; said reflector having a pair of correspondingly spaced openings therein, said looped member passing through said openings in said reflector, whereby said reflector is retained upon said sleeve against rotational and longitudinal movement, and said sleeve is maintained in assembled condition within said socket, irrespective of the engagement of said resilient detent means.

* * * * *